US007494532B2

(12) United States Patent
Azukizawa et al.

(10) Patent No.: US 7,494,532 B2
(45) Date of Patent: Feb. 24, 2009

(54) ELECTROSTATIC ATOMIZING DEVICE AND HUMIDIFIER USING THE SAME

(75) Inventors: Shigekazu Azukizawa, Hikone (JP); Sadahiko Wakaba, Hikone (JP); Hiroshi Suda, Takatsuki (JP)

(73) Assignee: Matsushita Electric Works, Ltd., Osaka (JP)

( * ) Notice: Subject to any disclaimer, the term of this patent is extended or adjusted under 35 U.S.C. 154(b) by 84 days.

(21) Appl. No.: 10/559,540

(22) PCT Filed: May 26, 2004

(86) PCT No.: PCT/JP2004/007595

§ 371 (c)(1),
(2), (4) Date: Dec. 2, 2005

(87) PCT Pub. No.: WO2004/110640

PCT Pub. Date: Dec. 23, 2004

(65) Prior Publication Data

US 2006/0131449 A1 Jun. 22, 2006

(30) Foreign Application Priority Data

Jun. 4, 2003 (JP) ..... 2003-160018

(51) Int. Cl.
*B03C 3/34* (2006.01)

(52) U.S. Cl. ..... 96/27; 96/53; 95/71; 239/690; 261/107

(58) Field of Classification Search ..... 239/34, 239/145, 326, 690, 697, 698; 392/337; 96/27, 96/52, 53; 95/71
See application file for complete search history.

(56) References Cited

U.S. PATENT DOCUMENTS

| | | | | | |
|---|---|---|---|---|---|
| 3,503,704 | A * | 3/1970 | Marks | 423/212 |
| 4,473,380 | A * | 9/1984 | Voliva et al. | 95/66 |
| 4,581,675 | A * | 4/1986 | Kelly | 361/228 |
| 4,696,719 | A * | 9/1987 | Bischoff | 202/205 |
| 5,337,963 | A | 8/1994 | Noakes | |
| 5,503,335 | A * | 4/1996 | Noakes et al. | 239/690 |
| 6,471,753 | B1 * | 10/2002 | Ahn et al. | 96/27 |

FOREIGN PATENT DOCUMENTS

| | | | |
|---|---|---|---|
| JP | 62-144774 | A | 6/1987 |
| JP | 2001-286546 | A | 10/2001 |
| JP | 3260150 | B2 | 12/2001 |
| JP | 2002-203657 | A | 7/2002 |
| JP | 2003-014261 | A | 1/2003 |
| JP | 2003-79714 | A | 3/2003 |

OTHER PUBLICATIONS

International Search Report.

* cited by examiner

*Primary Examiner*—Dinh Q Nguyen
(74) *Attorney, Agent, or Firm*—Cheng Law Group PLLC

(57) ABSTRACT

A carrier is used to carry a liquid, and a high voltage is applied between a discharge end of the carrier and an opposed electrode to emit ionized liquid particles. The carrier has a liquid collecting end opposite to the discharge end to feed the steam of the liquid from a steam generator, condensing the liquid therearound, and feeding the condensed liquid to the discharge end. Accordingly, even when the liquid contains cations such as those of Ca and Mg, the steam of the liquid can extremely reduce the content of these impurities, avoiding the precipitation of the impurities at the discharge end of the carrier to assure stable electrostatic atomization.

7 Claims, 6 Drawing Sheets

ELECTROSTATIC ATOMIZING DEVICE AND HUMIDIFIER USING THE SAME

TECHNICAL FIELD

The present invention relates to an electrostatic atomizing device for emitting a liquid in the form of tiny ionized particles and a humidifier using the same.

BACKGROUND ART

Japanese Patent Publication No. 3260150 discloses a prior electrostatically atomizing device. The atomizing device utilizes capillary structure as a liquid carrier to feed the liquid to discharge end of the carrier by a capillary effect. A high voltage is applied between the carrier and a surrounding housing to emit the liquid as ionized particles from the discharge end. When the device uses the water, for example, city water, electrolytic water, PH adjusted water, mineral water, vitamin-C or amino-acid contained water, or water containing a deodorant such as fragrant oil or aromatic, minerals such as Ca or Mg possibly contained in the water will advance to the distal end of the capillary structure and react with $CO_2$ in the air to precipitate as CaCO3 or MgO, hindering the electrostatic atomization. Therefore, it has been a problem to require maintenance of removing the precipitants regularly.

DISCLOSURE OF THE INVENTION

The present invention has been achieved to overcome the above problem and to present an electrostatically atomizing device and the humidifier using the same which can avoid the precipitation of impurities contained in the liquid at the discharge end of the carrier for maintaining stable electrostatic atomization over a long period of use.

The electrostatically atomizing device of the present invention includes a carrier having a liquid collecting end and a discharge end opposite of the liquid collecting end, the liquid collecting end collecting a liquid for feeding the liquid to the discharge end. The device includes a first electrode, a second electrode, and a voltage source. The voltage source applies a voltage across the first and second electrodes to charge the liquid at the discharge end, thereby emitting the liquid in the form of tiny ionized particles. The characterizing feature of the present invention is to include a steam supply which feeds a steam to the liquid collecting end of the carrier for condensation of the liquid therearound in order that the condensed liquid is fed to the discharge end of the carrier. Thus, even with the use of the liquid in which cation of Ca or Mg is dissolved, the content of Ca or Mg cation can be minimized by the effect of steam, thereby inhibiting the impurities from being fed to the discharge end of the carrier and avoiding the lowering of the electrostatic atomization by the precipitation of the impurities. Accordingly, frequent cleaning of the discharge end can be avoided to keep the stable electrostatic atomization over a long period of use.

Preferably, the case accommodating the carrier has its interior separated by a partition into a condensation compartment and a discharging compartment. The carrier extends through the partition to dispose the liquid collecting end within the condensation compartment, and the discharge end within the discharge compartment. The condensation compartment is communicated with the steam supply to be fed the steam therefrom to give the steam condensed liquid to the liquid collecting end. Thus, the condensation compartment serves as a condensation space to feed the condensed liquid effectively to the liquid collecting end.

The condensation compartment is preferably configured to make a circular flow of the steam around the liquid collecting end of the carrier. The circular flow increases the chance of contact between the steam and the carrier to improve condensation effect by cooling of the steam, assuring to feed the liquid stably to the discharge end of the carrier.

The condensation compartment may be provided with a liquid absorber for condensing the steam thereat and feeding the condensed liquid to the liquid collecting end of the carrier.

Further, the electrostatically atomizing device is preferred to include a fan producing a forced air flow, and an air duct introducing the forced air flow into between the discharge end and the second electrode. With this arrangement, the tiny ionized particles of the liquid generated between the discharge end and the second electrode is carried on the forced air flow to spread over a wide range. In this case, a baffle may be provided to shield the carrier from the forced air flow, avoiding undue evaporation of the liquid from the carrier.

Thus configured electrostatically atomizing device is preferably incorporated into an appliance such as a humidifier. The humidifier has a fan generating an forced air flow and a steam path for directing a portion of the steam from the steam supply as being carried on the forced air flow and emitting the steam outwardly. Consequently, in addition to general humidification effect by the steam, the tiny ionized particles of the liquid can be dispersed to improve skin beauty effect due to high skin penetration capability that the tiny ionized particles exhibit, as well as room deodorizing effect.

These and still other objects and advantageous features will become apparent from the detailed explanation of the preferred embodiment when taken in conjunction with the drawings.

BEST MODE FOR CARRYING OUT THE INVENTION

Figure 1:
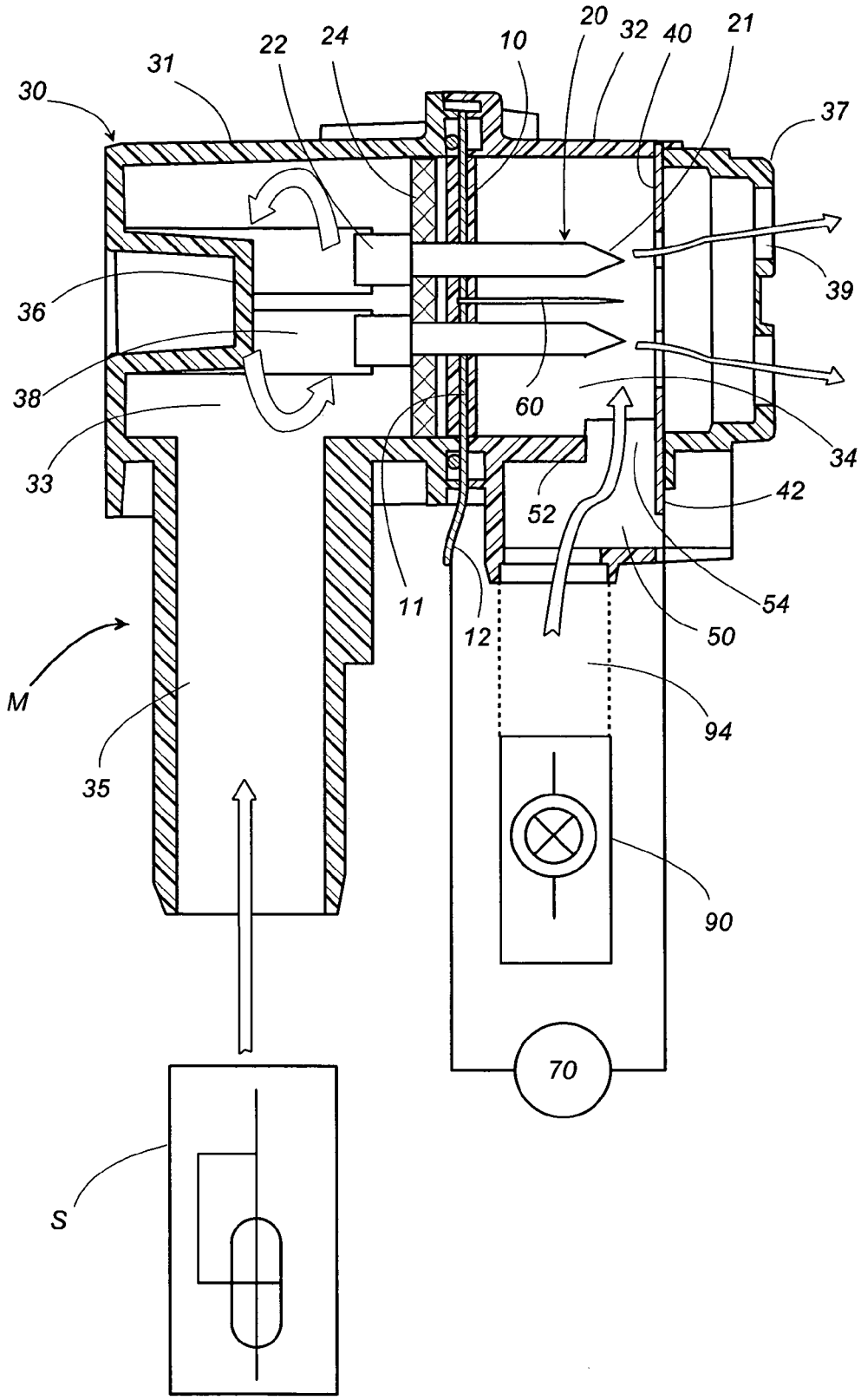
FIG. 1 is a vertical section of an electrostatically atomizing device in accordance with an embodiment of the present invention.

An electrostatically atomizing device in accordance with one embodiment of the present invention is configured to ionize particulate water, for example, so as to generate ionized water particles of a nanometer size, and include an atomizing unit M for electrostatically atomizing the liquid, and a steam generator S providing a steam of water. As shown in FIG. 1, the atomizing unit M includes a case 30 accommodating a plurality of capillary carriers 20. The case 30, which is made of a first tube 31 and a second tube 32 coupled to each other, has its interior space divided by a partition 10 into a condensation compartment 33 and a discharge compartment 34. The capillary carrier 20 extends through the partition 10 as being held thereby to define a liquid collecting end 22 at its portion projecting into the condensation compartment 33, while defining a discharge end 21 at its pointed end of a portion projecting into the discharge compartment 34. Extending from the first tube 31 surrounding the condensation compartment 33 is a duct 35 for introducing the steam from the steam generator S, thereby collecting the condensed water at the liquid collecting end of each capillary carrier 20. The condensed water is absorbed in the liquid collected end 22, and is accumulated in an absorber 24 which is mounted around the liquid collected end 22 and act to feed the condensed water also to the capillary carriers 20.

A stud 36 projects from the inner bottom of the first tube 31. A plurality of axles 38 extends from the stud 36 to support the liquid collecting ends of the capillary carriers 20. The axles 38 and the capillary carriers 20 are located centrally within the condensation compartment 33 to define an annular space around these parts. Thus, the steam supplied into the condensation compartment 33 is caused to give a circular flow as indicted by arrows in FIG. 1, prompting the cooling effect to enhance the condensation of water, and therefore supplying the water constantly to the liquid collecting ends of the capillary carriers 20.

The partition 10 is embedded with a first electrode 11 which is connected to the capillary carriers 20 to charge the water being carried through the carriers 20. The first electrode 11 has a terminal 12 for connection with an external high voltage source 70. The second tube 32 surrounding the second compartment 34 has a front opening within which a second electrode 40 disposed. A high voltage generated at the high voltage source 70 is applied across the first and second electrodes 11 and 40. The high voltage is applied continuously or in the form of a pulse across the electrode plate 40 and the partition 10.

Each of the capillary carriers 20 is made of a porous ceramic and shaped into a porous bar having a diameter of about 5 mm and a length of about 70mm in order to feed the water collected at the liquid collecting end 22 to the discharge end 21 by the capillary effect.

The high voltage source 70 is configured to apply the high voltage having an electric field strength of 500 V/mm, for example, between the first electrode 11 and the second electrode 40, developing an electrostatic atomization between the discharge end 21 at the distal end of the capillary carrier 20 and the second electrode 40 opposed to the discharge end such that tiny ionized water particles are emitted from the discharge end 21 towards the second electrode 40. That is, the high voltage induces Rayleigh disintegration of the water being emitted from the discharge end, thereby generating negatively-charged water particles and emitting the mist of the tiny ionized water particles.

Figure 2:
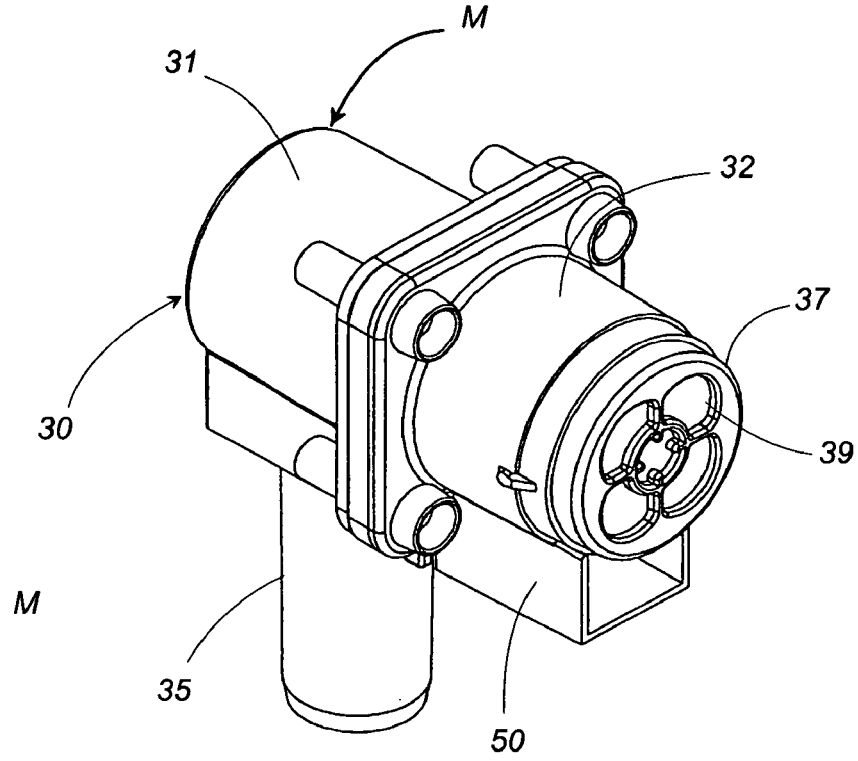
FIG. 2 is a perspective view of an atomizing unit in the above device.
Figure 3:
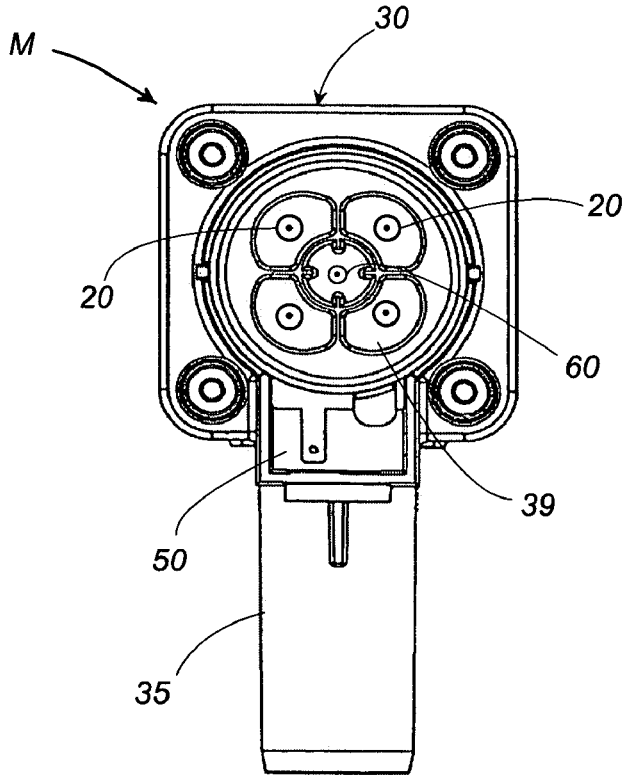
FIG. 3 is a side view of the atomizing unit.
Figure 4:
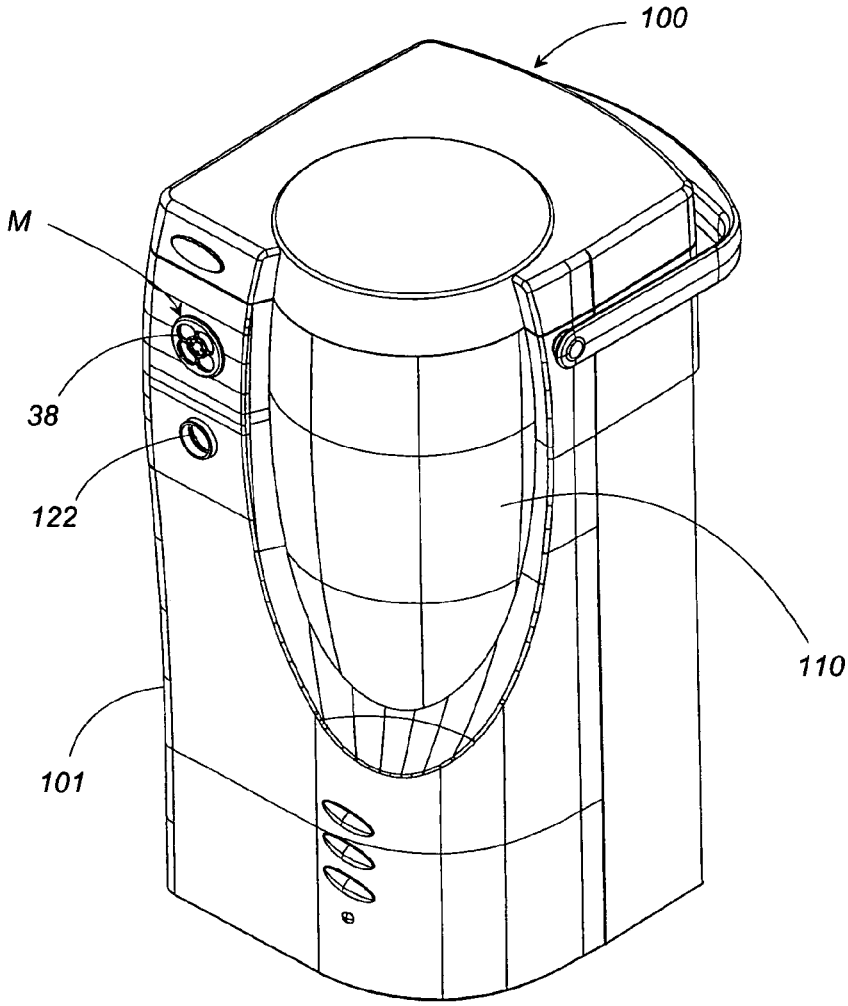
FIG. 4 is a perspective view of a humidifier incorporating the atomizing unit.
Figure 5:
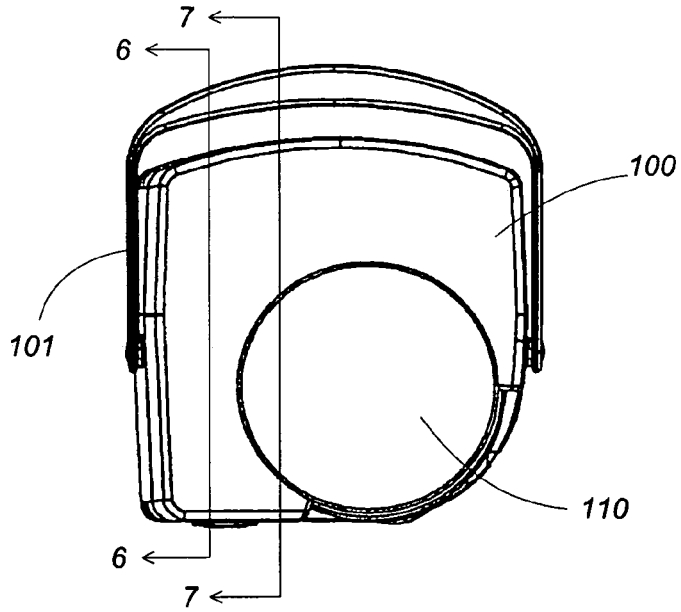
FIG. 5 is a top view of the humidifier.

The second electrode 40 is molded from an electrically conductive resin and shaped into a circular electrode plate having a plurality of openings. Each opening has its periphery disposed in a closely opposed relation to the discharge end 21 to make the discharge between the periphery and the discharge end 21. The second electrode is formed on its periphery with a terminal 42 for connection with the high voltage source 70. The second tube 32 is fitted with a cover 37 which is made of a dielectric material and is formed with discharge ports 39 in correspondence with the openings of the second electrode 40, as see in FIGS. 2 and 3.

Each of the capillary carriers 20 is made of the porous ceramic material of particle size of 2 to 500 μm and has a porosity of 10 to 70% to feed the water to the discharge end 21 by the capillary effect using minute paths in the ceramic. The ceramic is selected from one or any combination of alumina, titania, zirconia, silica, and magnesia, and is selected to have a PH at the isoelectric point lower than PH of the water in use. The basis of such selection is related to mineral components such as Mg and Ca possibly contained in the water being utilized. The mineral components contained in the water are refrained from advancing to the discharge end of the capillary carrier 20 and therefore refrained from reacting with $CO_2$ in the air to precipitate as MgO or $CaCO_3$ which would otherwise impede the electrostatic atomization effect. That is, the electroosmotic flow in the capillary carriers 20 can be best utilized so that Mg or Ca ions dispersed in the water is prevented from advancing to the discharge end 21.

The partition 10 supports at its center an ionizing needle 60 which is electrically charged to the same potential as the capillary carriers 20. The ionizing needle 60 has a pointed end projecting in the discharge compartment 34 in alignment with the discharge ends 21 of the capillary carriers 20. The capillary carriers 20 are evenly spaced in a circle concentric to the ionizing needle 60. The ionizing needle 60 is opposed to a center opening of the second electrode 40 to cause a corona discharge therebetween, thereby negatively charging molecules such as oxygen, oxide, or nitride in the air to generate negatively charged ions, while restraining the generation of ozone. Thus, by applying of the high voltage negative potential to the ionizing needle 60 and the capillary carriers 20, the negatively charged ions are generated from the ionizing needle 60 concurrently with the atomization of the liquid at the discharge ends 21.

An air introduction chamber 50 is formed on one circumferential portion around the second tube 32. The air introduction chamber 50 is connected through an air duct 94 to a fan 90 in order to introduce a forced air flow generated at the fan 90 and direct the air flow in the discharge compartment 34, whereby the resulting air flow goes from the discharge compartment 34 through the discharge ports 39 of the cover 37. The ionized tiny water particles of negative charge generated between the discharge end 21 and the second electrode 40 as well as the negatively charged ions generated between the emitter needle 60 and the second electrode 40 are carried on the air flow to be spread in the form of a mist into a wide space. A baffle 52 is disposed between the discharge compartment 34 and the air introduction chamber 50 so as to protect the capillary carriers 20 from being directly exposed to the forced air flow being introduced to the air introduction chamber 50, but to allow the forced air flow to be directed through an inlet 54 at the front end of the baffle 52 to between the discharge ends 21 of the capillary carriers 20 and the second electrode 40.

Figure 6:
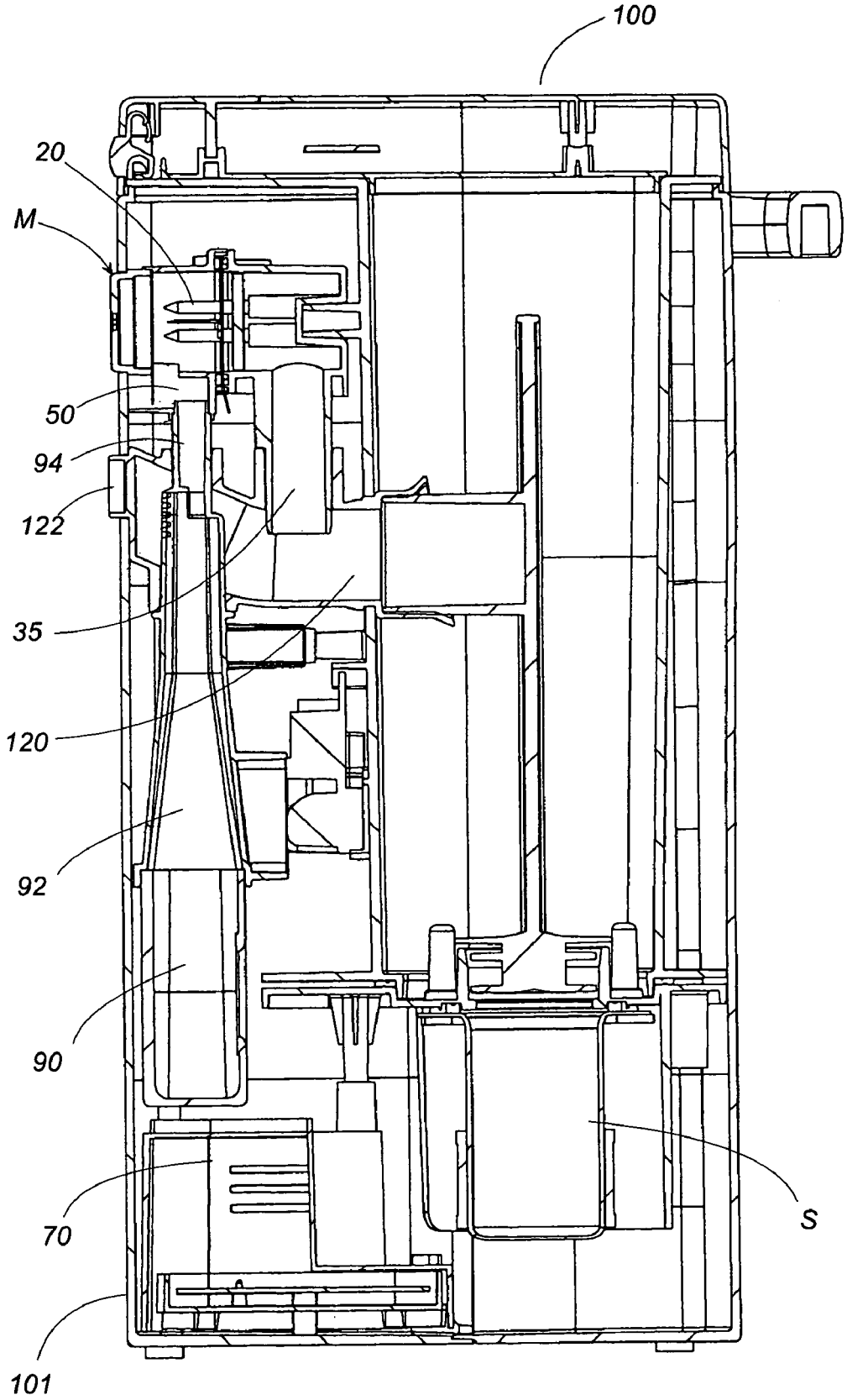
FIG. 6 is a cross-section taken along line 6-6 of FIG. 5.
Figure 7:
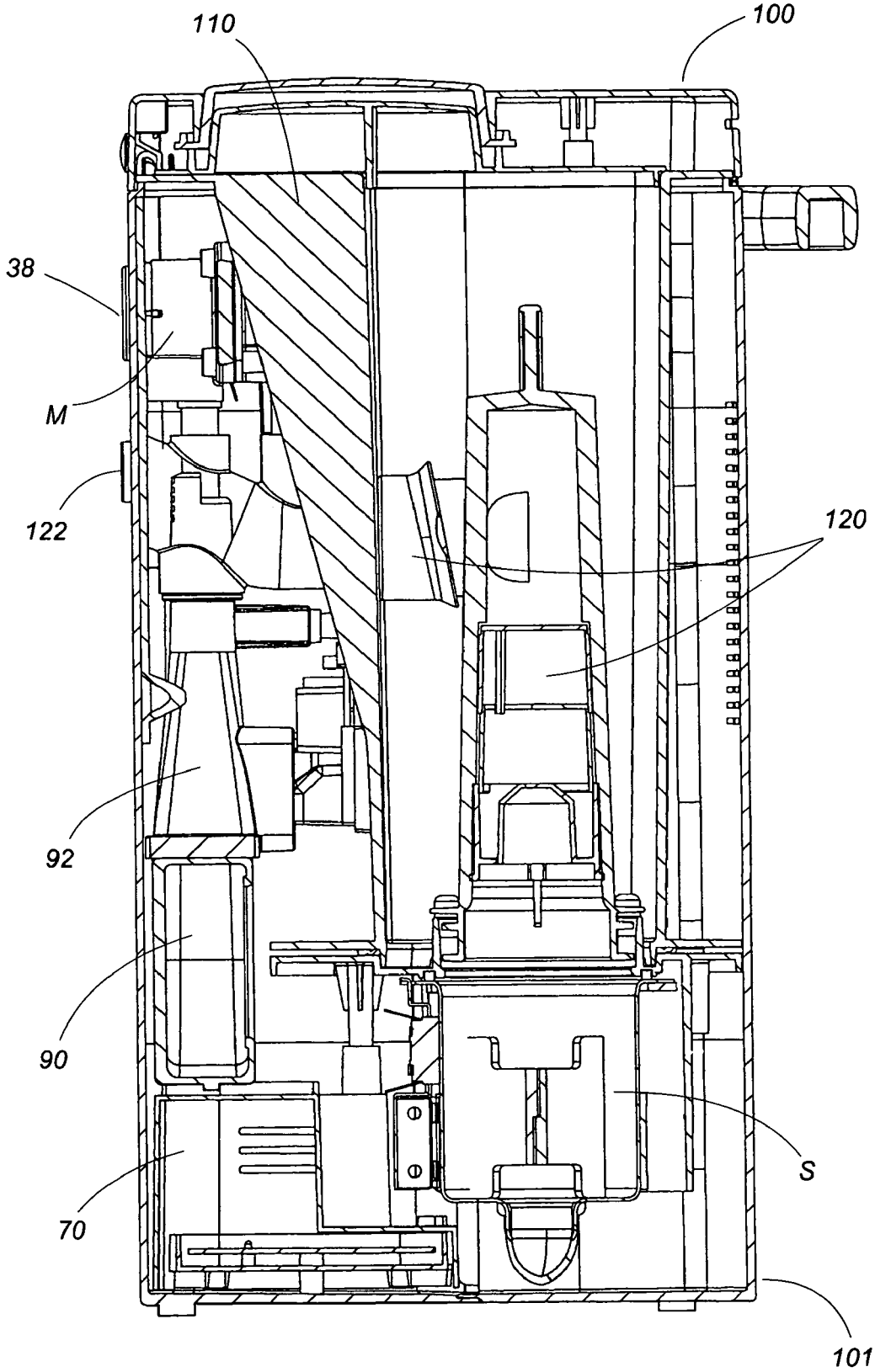
FIG. 7 is a cross-section taken along line 7-7 of FIG. 5.

FIGS. 4 to 7 illustrate one example in which the atomizing unit M is incorporated into the humidifier 100. The humidifier 100 includes a housing 101 with a detachable tank 110, the housing 101 accommodating therein a steam generator S, a fan 90, and a high voltage source 70. The steam generator S is configured to heat the water being supplied from the water tank 110 to generate the steam, which is discharged through a steam discharge path 120 and out of a steam port 122 at the front of the housing 101, as shown in FIGS. 6 and 7. The steam discharge path 120 has its portion communicated with the duct 35 for supplying the steam to the condensation compartment 33 of the atomizing unit M. The fan 90 is communicated through an air path 92 with the steam discharge path 120 immediately upstream of the steam port 122, thereby giving off the steam out of the steam port 122 as being carried on the forced air flow from the fan 90. The air path 92 is also communicated with the air duct 94 of the atomizing unit M to direct the part of the forced air flow into the discharge compartment 34 by way of the air introduction chamber 50, whereby the tiny ionized water particles and the negative ions generated within the discharge compartment 34 are carried on the forced air flow to be emitted out of the discharge port 39 of the cover 37.

Although the illustrated embodiment is configured to supply the part of the steam from the steam generator S into the atomizing unit M while emitting the rest of the steam out of the steam port 122, it may be configured to supply the entire steam into the atomizing unit M.

When the mist of the tiny ionized water particles caused by the electrostatic atomization is generated at a rate of 0.02 ml/m within an electric field strength of 500 V/mm or more with the use of the capillary carrier 20 of which tip diameter is 0.5 mm or below, the mist contains the very fine ionized particles having the nanometer particle size of 3 to 100 nm, which react with the oxygen in the air to give the radicals such as hydroxyl radicals, superoxides, nitrogen monoxide radicals, and oxygen radicals. The mist of the tiny ionized water particles, when released into a room, can deodorize substances contained in the air or adhered to the walls. The following are reaction formulas between the radicals and various kinds of odor gases.

ammonia: $2NH_3+6.OH \rightarrow N_2+6H_2O$ acetaldehyde: $CH_3CHO+6.OH+O_2 \rightarrow 2CO_2+5H_2O$ acetic acid: $CH_3COOH+4.OH+O_2 \rightarrow 2CO_2+4H_2O$ methane gas: $CH_4+4.OH+O_2 \rightarrow CO_2+H_2O$ carbon monoxide: $CO+2.OH \rightarrow CO_2+4H_2O$ nitrogen monoxide: $2NO+4.OH \rightarrow N_2+2O_2+2H_2O$ formaldehyde: $HCHO+4.OH \rightarrow CO_2+3H_2O$ In addition, the tiny ionized water particles of nano-meter size can well penetrate into keratinous membrane in human skin to improve moisture retention of the skin.

Figure 8:
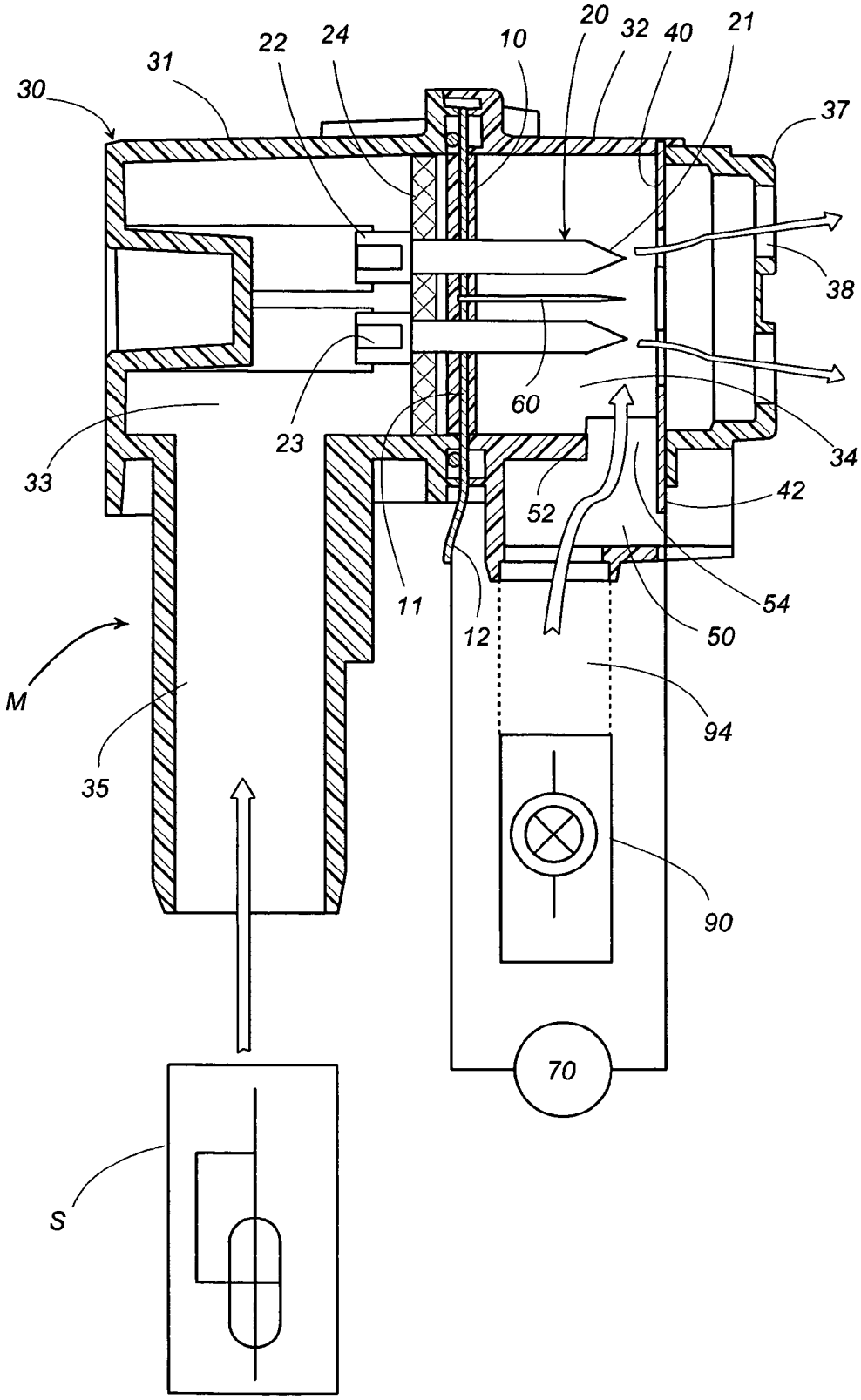
FIG. 8 is a cross-section illustrating a modification of the atomizing unit.

FIG. 8 illustrates a modification of the above atomizing unit M which is similar in structure to the above atomizing unit except for a concave 23 formed in the liquid collecting end 22 of the capillary carrier 20. The similar elements are designated by the same reference numerals. The concave 23 increases the contact area of the capillary carrier 20 with the steam to obtain more amount of the condensed water, enhancing the efficiency of supplying the water to the capillary carriers 20.

Although the above embodiment is explained with reference to an example in which the water is utilized to generate mist of the tiny ionized water particles, the present invention is not limited to the particular embodiment, and can be applicable to the use of the various liquids other than the water. The available liquid includes the water containing valuable components such as vitamin C, amino acids, a deodorant such as fragrant oil or aromatic, and includes a colloidal solution such as a make-up lotions.

The invention claimed is:

1. An electrostatically atomizing device comprising:

a capillary carrier having a liquid collecting end and a discharge end opposite of said liquid collecting end, said liquid collecting end collecting a liquid for feeding the liquid through said carrier to said discharge end, a first electrode electrically charging said liquid, a second electrode opposed to said discharge end, a voltage source applying a voltage across said first and second electrodes to thereby electrostatically charge the liquid at said discharge end and emitting the said liquid in the form of tiny ionized particles, a steam supply that provides a steam of said liquid and feeding said steam to said liquid collecting end of said carrier for condensation of said liquid therearound in order that the condensed liquid is fed through said carrier to said discharge end.

2. The device as set forth in claim 1, wherein said carrier is mounted within a case which is separated by a partition into a condensation compartment and a discharging compartment, said carrier extending through said partition to confine said liquid collecting end and said discharge end respectively within said condensation compartment and said discharging compartment, said condensation compartment communicating with said steam supply to be supplied with said steam.

3. An electrostatically atomizing device comprising:

a capillary carrier having a liquid collecting end and a discharge end opposite of said liquid collecting end, said liquid collecting end collecting a liquid for feeding the liquid through said carrier to said discharge end, a first electrode electrically charging said liquid, a second electrode opposed to said discharge end, a voltage source applying a voltage across said first and second electrodes to thereby electrostatically charge the liquid at said discharge end and emitting the said liquid in the form of tiny ionized particles, a steam supply that provides a steam of said liquid and feeding said steam to said liquid collecting end of said carrier for condensation of said liquid therearound in order that the condensed liquid is fed through said carrier to said discharge end, wherein said carrier is mounted within a case which is separated by a partition into a condensation compartment and a discharging compartment, said carrier extending through said partition to confine said liquid collecting end and said discharge end respectively within said condensation compartment and said discharging compartment, said condensation compartment communicating with said steam supply to be supplied with said steam, and said condensation compartment being configured to make a circular flow of said steam around the liquid collecting end of said carrier.

4. An electrostatically atomizing device comprising:

a capillary carrier having a liquid collecting end and a discharge end opposite of said liquid collecting end, said liquid collecting end collecting a liquid for feeding the liquid through said carrier to said discharge end, a first electrode electrically charging said liquid, a second electrode opposed to said discharge end, a voltage source applying a voltage across said first and second electrodes to thereby electrostatically charge the liquid at said discharge end and emitting the said liquid in the form of tiny ionized particles, a steam supply that provides a steam of said liquid and feeding said steam to said liquid collecting end of said carrier for condensation of said liquid therearound in order that the condensed liquid is fed through said carrier to said discharge end, wherein said carrier is mounted within a case which is separated by a partition into a condensation compartment and a discharging compartment, said carrier extending through said partition to confine said liquid collecting end and said discharge end respectively within said condensation compartment and said discharging compartment, said condensation compartment communicating with said steam supply to be supplied with said steam, and said condensation compartment is provided with a liquid absorber for condensing said steam and feeding the condensed liquid to said liquid collecting end of said carrier.

5. The device as set forth in claim 1, further including a fan producing a force air flow; and an air duct introducing said forced air flow into between said discharge end and said second electrode.

6. An electrostatically atomizing device comprising:

a capillary carrier having a liquid collecting end and a discharge end opposite of said liquid collecting end, said liquid collecting end collecting a liquid for feeding the liquid through said carrier to said discharge end, a first electrode electrically charging said liquid, a second electrode opposed to said discharge end, a voltage source applying a voltage across said first and second electrodes to thereby electrostatically charge the liquid at said discharge end and emitting the said liquid in the form of tiny ionized particles, a steam supply that provides a steam of said liquid and feeding said steam to said liquid collecting end of said carrier for condensation of said liquid therearound in order that the condensed liquid is fed through said carrier to said discharge end, a fan producing a force air flow, an air duct introducing said forced air flow into between said discharge end and said second electrode, and a baffle shielding said carrier from said forced air flow.

7. A humidifier including the electrostatically liquid misting device as defined in claim 1, said humidifier including a housing provided with a fan producing a forced air flow said housing including an steam duct which receives a portion of said steam from said steam supply to carry said steam on said forced air flow to direct the steam outside of said housing.

* * * * *